US006142332A

United States Patent [19]

Ferrara

[11] Patent Number: 6,142,332

[45] Date of Patent: Nov. 7, 2000

[54] CONTAINER LID AND CUTTING BOARD APPARATUS

[76] Inventor: Sandra Ferrara, 3820 NW. 10th St., Delray Beach, Fla. 33445

[21] Appl. No.: 09/389,306

[22] Filed: Sep. 2, 1999

Related U.S. Application Data

[60] Provisional application No. 60/102,989, Oct. 5, 1998.

[51] Int. Cl.[7] ..... B65D 41/56

[52] U.S. Cl. ..... 220/212; 220/796; 220/805

[58] Field of Search ..... 220/212, 212.5, 220/574, 796, 805

[56] References Cited

U.S. PATENT DOCUMENTS

| | | | |
|---|---|---|---|
| D. 360,105 | 7/1995 | Doxey . | |
| 1,891,151 | 12/1932 | Florang . | |
| 4,305,166 | 12/1981 | Rose . | |
| 4,989,846 | 2/1991 | Quinn . | |
| 5,331,945 | 7/1994 | Somerton . | |
| 5,423,451 | 6/1995 | Snyder . | |
| 5,456,352 | 10/1995 | McQueeny | 206/223 |
| 5,616,392 | 4/1997 | Treutwein | 220/574 X |
| 5,636,469 | 6/1997 | Pizzolo et al. | 206/315.11 X |

*Primary Examiner*—Stephen K. Cronin
*Attorney, Agent, or Firm*—S. Michael Bender

[57] ABSTRACT

A container lid and cutting board apparatus includes a rigid central panel portion and a flexible peripheral container-connector portion attached to the central panel portion. The peripheral container-connector portion includes a bridging ring portion attached to the central panel portion, and a container rim reception flange is attached to the bridging ring portion. The central panel portion has a panel thickness. The bridging ring portion has a ring thickness, and the panel thickness is greater than the ring thickness. The central panel portion and the peripheral container-connector portion are made as a unified structure from a single piece of plastic material. When the container lid and cutting board apparatus is placed on a surface upside down, the central panel portion can be used as a cutting board. Then, a container can be turned upside down, and the upper rim of the container can be fitted into the container rim reception flange to fix the container lid and cutting board apparatus and the container together. Then, the combination of the container lid and cutting board apparatus and the container can be inverted and stored in a conventional manner.

6 Claims, 3 Drawing Sheets

FIG 1
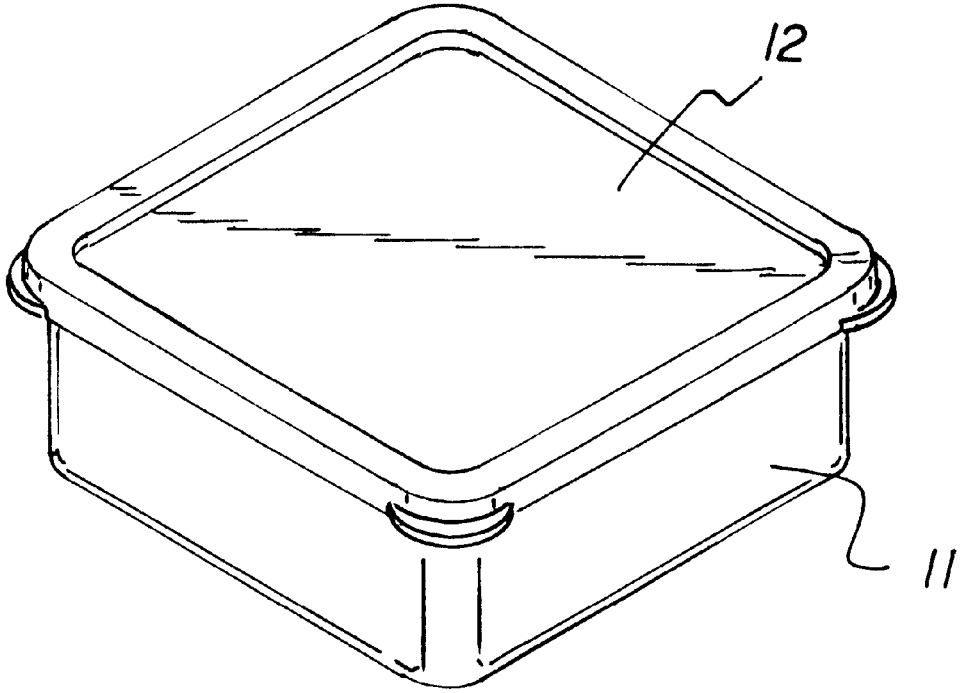
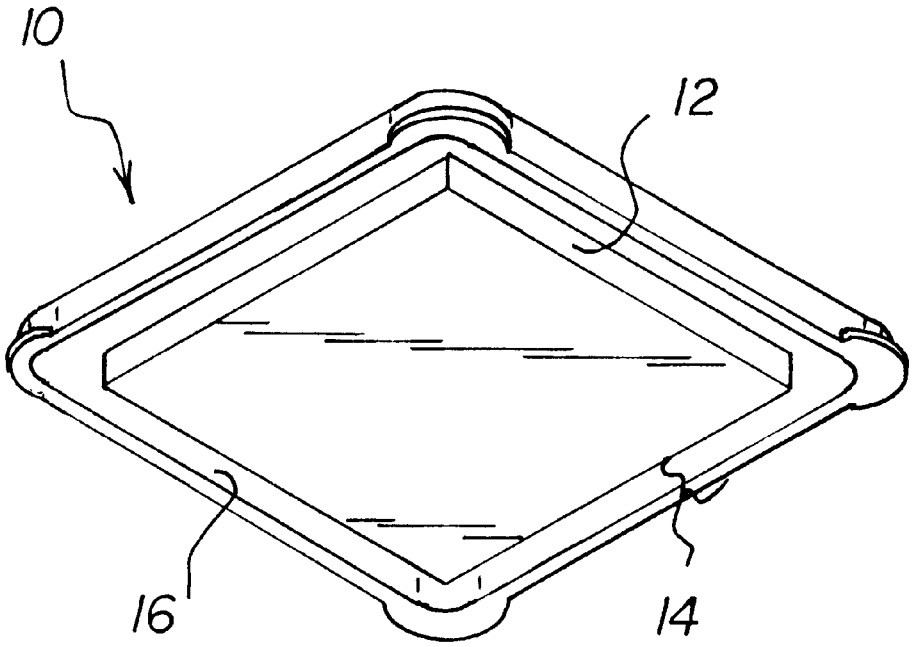
FIG 2

FIG 5
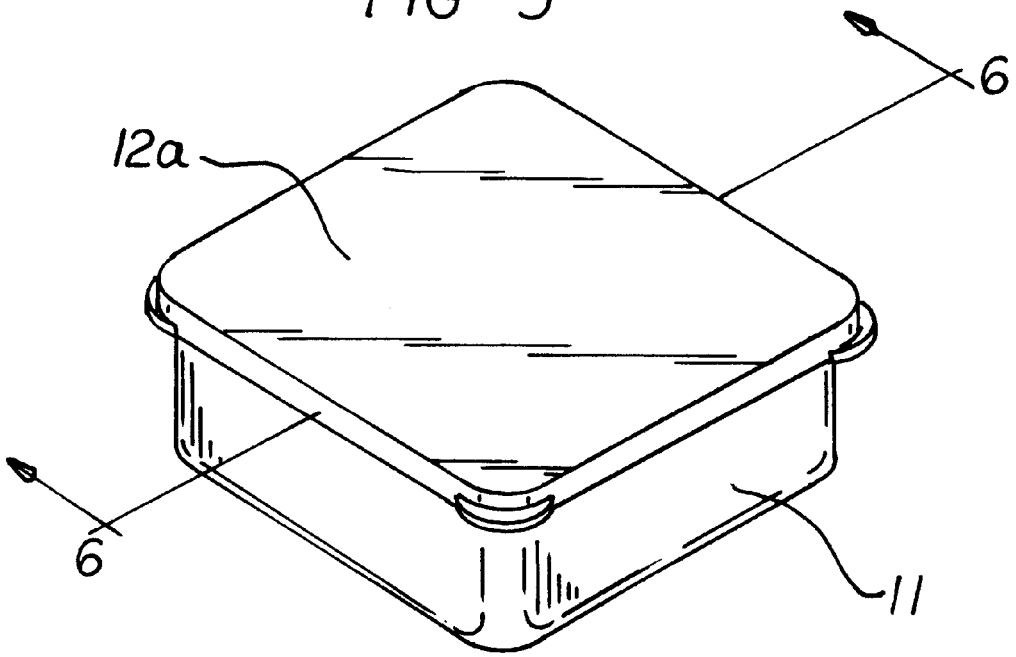
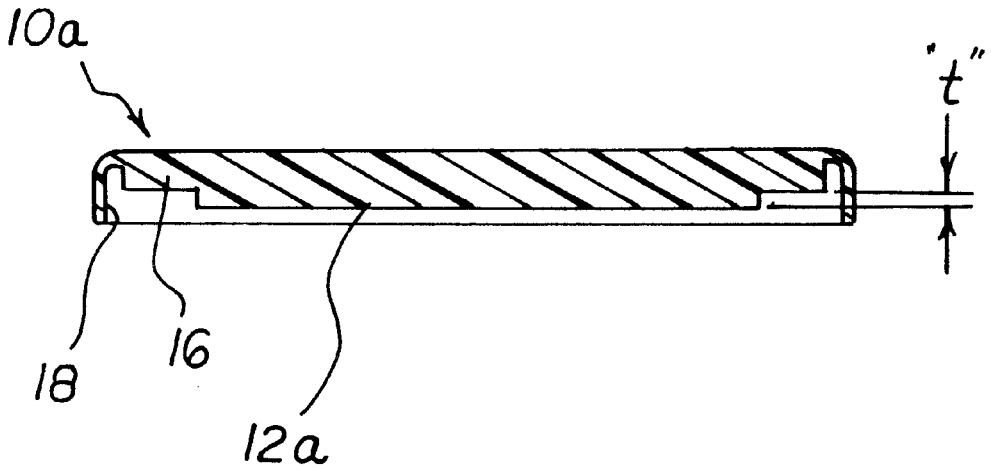
FIG 6

CONTAINER LID AND CUTTING BOARD APPARATUS

CROSS-REFERENCE TO RELATED APPLICATION

This application claims priority based upon my copending Provisional Application Ser. No. 60/102,989, filed Oct. 5, 1998.

BACKGROUND OF THE INVENTION

1. Field of the Invention

The present invention relates generally to container lids and also relates to cutting boards.

2. Description of the Prior Art

Containers that have flat planar lids are very common. Such containers and lids are commonly used for retaining home prepared or leftover foods. Further with respect to foods prepared at home, common food preparation steps include cutting or chopping of food items. Often a cutting board is used for cutting and chopping foods. Once the foods are cut or chopped, they can then be transferred to a container. Then, the lid is placed on the container, and the cutting/chopping board is then cleaned. In view of the above, to save time and labor, it would be desirable after cutting and chopping foods, if it would not be necessary to clean a cutting/chopping board.

Cutting/chopping boards are often flat surfaces which do not retain juices which flow out from foods that are cut. In this respect, it would be desirable if a cutting board were provided which retains juices which flow out from foods that are cut.

Generally, lids for food containers are made from relatively thin materials. As such, the lids would be easily damaged if cutting or chopping would be carried out on a food container lid. To avoid damaging a lid if cutting or chopping would be carried out thereon, it would be desirable if a lid for a food container had a thick layer which would not be damaged if cutting or chopping is carried out thereon.

Thus, in view of the above, it would be desirable if a container lid and cutting board apparatus were provided which has the following combination of desirable features: (1) after cutting and chopping foods, it is not necessary to clean a cutting/chopping board; (2) retains juices which flow out from foods that are cut; and (3) has a lid for a food container which has a thick layer which would not be damaged if cutting or chopping is carried out thereon. The foregoing desired characteristics are provided by the unique container lid and cutting board apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a container lid and cutting board apparatus which includes a substantially central panel portion and a flexible peripheral container-connector portion attached to the central panel portion. The peripheral container-connector portion includes a bridging ring portion attached to the central panel portion, and a container rim reception flange is attached to the bridging ring portion. The central panel portion has a panel thickness. The bridging ring portion has a ring thickness, and the panel thickness is greater than the ring thickness. The central panel portion and the peripheral container-connector portion are made as a unified structure from a single piece of plastic material. When the container lid and cutting board apparatus is placed on a surface upside down, the central panel portion can be used as a cutting board. Then, a container can be turned upside down, and the upper rim of the container can be fitted into the container rim reception flange to fix the container lid and cutting board apparatus and the container together. Then, the combination of the container lid and cutting board apparatus and the container can be inverted and stored in a conventional manner.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved container lid and cutting board apparatus which has all of the advantages of the prior art and none of the disadvantages.

It is another object of the present invention to provide a new and improved container lid and cutting board apparatus which may be easily and efficiently manufactured and marketed.

It is a further object of the present invention to provide a new and improved container lid and cutting board apparatus which is of durable and reliable construction.

An even further object of the present invention is to provide a new and improved container lid and cutting board apparatus which is susceptible of a low cost of manufacture with regard to both materials and labor, and which accordingly is then susceptible of low prices of sale to the consuming public, thereby making such container lid and cutting board apparatus available to the buying public.

Still yet a further object of the present invention is to provide a new and improved container lid and cutting board apparatus which after cutting and chopping foods, it is not necessary to clean a cutting/chopping board.

Still another object of the present invention is to provide a new and improved container lid and cutting board apparatus that retains juices which flow out from foods that are cut.

Yet another object of the present invention is to provide a new and improved container lid and cutting board apparatus which has a lid for a food container which has a thick layer which would not be damaged if cutting or chopping is carried out thereon.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a top perspective view showing a preferred embodiment of the container lid and cutting board apparatus of the invention in combination with a container.

FIG. 2 is a bottom perspective view of the embodiment of the invention shown in FIG. 1 removed from the container.

FIG. 5 is a top perspective view showing an alternatively preferred embodiment of the container lid and cutting board apparatus of the invention in combination with a container.

FIG. 6 is a cross-sectional of the embodiment of the invention shown in FIG. 5 taken along line 6—6 thereof.

DESCRIPTION OF THE PREFERRED EMBODIMENT

Figure 3:
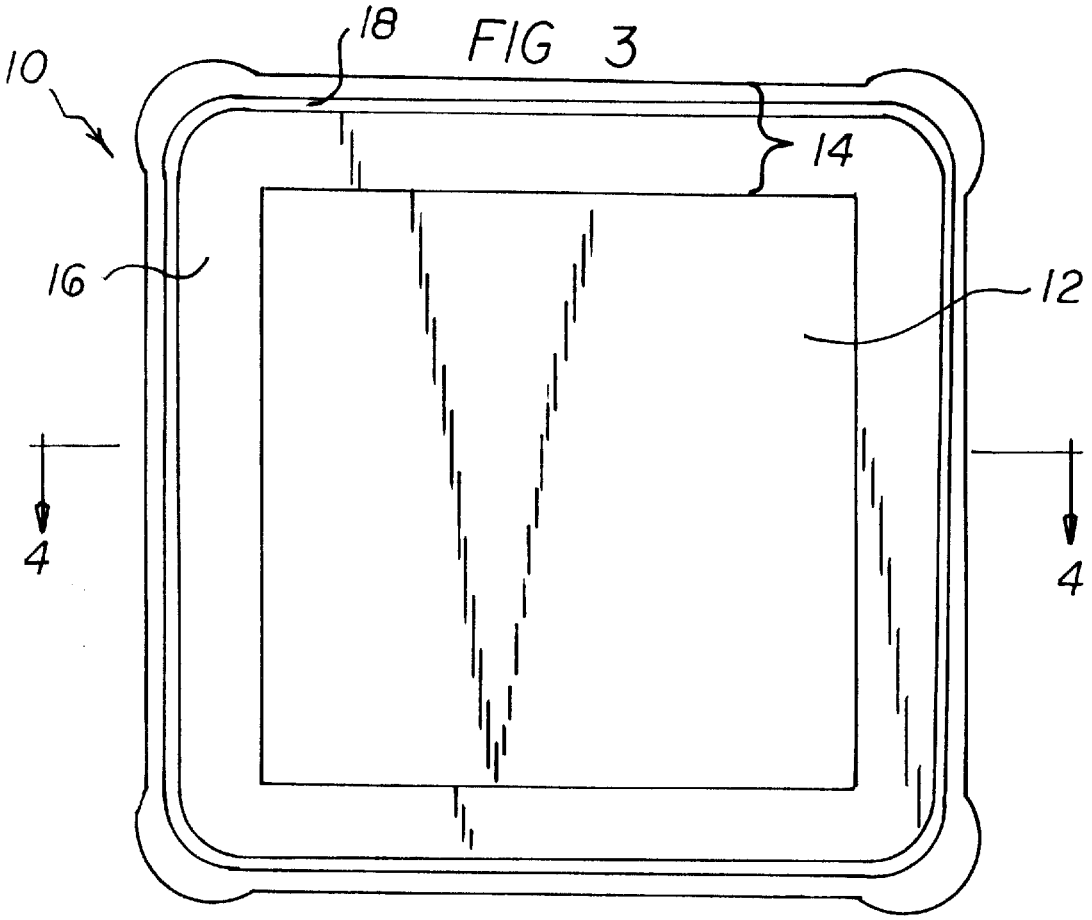
FIG. 3 is an enlarged bottom plan view of the embodiment of the invention shown in FIG. 2.
Figure 4:
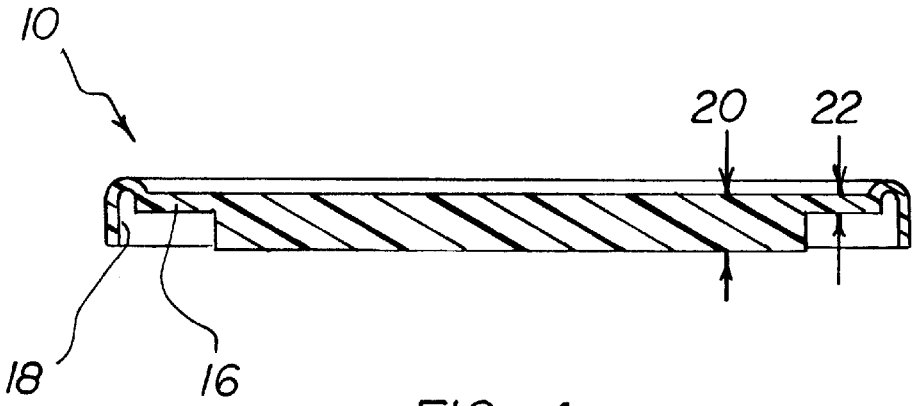
FIG. 4 is a cross-sectional view of the embodiment of the invention shown in FIG. 3 taken along line 4—4 thereof.

With reference to the drawings, a new and improved container lid and cutting board apparatus embodying the principles and concepts of the present invention will be described.

Turning to FIGS. 1–4, there is shown an exemplary embodiment of the container lid and cutting board apparatus of the invention generally designated by reference numeral 10. In its preferred form, container lid and cutting board apparatus 10 includes a substantially central panel portion 12 and a flexible peripheral container-connector portion 14 attached to the central panel portion 12. The peripheral container-connector portion 14 includes a bridging ring portion 16 attached to the central panel portion 12, and a container rim reception flange 18 is attached to the bridging ring portion 16. The central panel portion 12 has a panel thickness 20. The bridging ring portion 16 has a ring thickness 22, and the panel thickness 20 is greater than the ring thickness 22. The central panel portion 12 and the peripheral container-connector portion 14 are made as a unified structure from a single piece of plastic material. Owing to its thickness, the central panel portion is substantially rigid. When the container lid and cutting board apparatus 10 is placed on a surface upside down, the central panel portion 12 can be used as a cutting board. Then, a container 11 can be turned upside down, and the upper rim of the container 11 can be fitted into the container rim reception flange 18 to fix the container lid and cutting board, apparatus 10 and the container 11 together. Then, the combination of the container lid and cutting board apparatus 10 and the container 11 can be inverted and stored in a conventional manner.

As shown in FIG. 1, the container lid and cutting board apparatus 10 of the invention is secured to a container 11. Although not shown in the drawing, the container 11 has an upper rim which fits into the container rim reception flange 18 of the peripheral container-connector portion 14. The upper rim of the container 11 and the container rim reception flange 18 form a tight friction fit, as with conventional containers, such as conventional food storage containers. One or more arcuate finger-grip extensions may be integrally formed on a corner or corners of the flexible peripheral container-connector portion 14, substantially as illustrated, to facilitate attachment or removal of the container lid and cutting board apparatus 10 with respect to its associated container 11.

When the container lid and cutting board apparatus 10 of the invention is used as a cutting board, the apparatus is turned upside down as shown in FIG. 3. In this orientation, the central panel portion 12 can serve as a cutting board. The bridging ring portion 16 and the container rim reception flange 18 serve to retain liquids that flow off the cutting board when it is in use.

More specifically, the central panel portion 12 can be used as a cutting board to cut, chop, or dice food items, such as onions, celery, carrots, etc., which are used for lunch or dinner salads. After the food is cut on the central panel portion 12, the food is left on the central panel portion 12, and the container 11 is inverted and placed over and pushed into the container lid and cutting board apparatus 10 so that the upper rim of the container is fixed into the container rim reception flange 18. Then, the combination of the container lid and cutting board apparatus 10 of the invention and the container 11 can be stored in a refrigerator without the need for transferring food from a conventional cutting board and without the need for cleaning a conventional cutting board. The container rim reception flange 18 and the upper rim of the container 11 can form an airtight seal as with conventional food storage containers. The container lid and cutting board apparatus 10 are made from plastic materials which are dishwasher safe.

FIGS. 5 and 6 illustrate an alternatively preferred embodiment of the cutting board apparatus 10*a* wherein the central panel portion 12*a* is coplanar with the top surface of the flexible peripheral container-connector portion 14 common to the bridging ring portion 16 (i.e. substantially the entire top surface of the container lid is substantially flat and there is no recess as in the embodiment shown in FIGS. 1–4). By this arrangement, when the container is turned over, the cutting board central panel portion 12*a* lies flat on a table surface or the like. In an exemplary version of the embodiment of FIGS. 5 and 6, and without limiting the invention, the dimension "t" will be about 0.12 inches and the bridging ring portion width (transverse extent as viewed in FIG. 6) will be about 1.00 inches. It will be appreciated that dimension "t" should be sufficient to impart rigidity to the cutting board central panel portion 12*a*, without unduly protruding into the interior of container 11 to take up food storage space. In this regard, it will be observed that in FIGS. 5 and 6, the container rim reception flange 18 of the flexible peripheral container-connector portion bottom surface extends beyond (below) the central panel portion bottom surface. This is opposite to the arrangement in FIGS. 1–4, wherein the central panel portion bottom surface extends beyond (below) the container rim reception flange 18 of the flexible peripheral container-connector portion bottom surface.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved container lid and cutting board apparatus that is low in cost, relatively simple in design and operation, and which may advantageously be used without needing to clean a cutting/chopping board. With the invention, a container lid and cutting board apparatus is provided which retains juices which flow out from foods that are cut. With the invention, a container lid and cutting board apparatus is provided which has a lid for a food container which has a thick layer which would not be damaged if cutting or chopping is carried out thereon.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A container lid and cutting board apparatus, comprising:

a rigid central panel portion, and a flexible peripheral container-connector portion attached to said central panel portion, wherein said peripheral container-connector portion includes:

a bridging ring portion attached to said central panel portion, and a container rim reception flange attached to said bridging ring portion, wherein said central panel portion has a panel thickness, said bridging ring portion has a ring thickness, and said panel thickness is greater than said ring thickness, wherein said flexible peripheral container-connector portion and said central panel portion each has a first surface and a second opposed surface, wherein said flexible peripheral container-connector portion further includes at least one finger-gripping extension integral therewith, and wherein said finger-gripping extension is arcuate shaped.

2. The apparatus of claim 1 wherein said central panel portion and said peripheral container-connector portion are made as a unified structure from a single piece of plastic material.

3. A container lid and cutting board apparatus, comprising:

a rigid central panel portion, and a flexible peripheral container-connector portion attached to said central panel portion, wherein said peripheral container-connector portion includes:

a bridging ring portion attached to said central panel portion, and a container rim reception flange attached to said bridging ring portion, wherein said central panel portion has a panel thickness, said bridging ring portion has a ring thickness, and said panel thickness is greater than said ring thickness, wherein said flexible peripheral container-connector portion and said central panel portion each has a first surface and a second opposed surface, and wherein said flexible peripheral container-connector portion second opposed surface includes a container rim reception flange and said central panel portion second opposed surface extends beyond said container rim reception flange.

4. The apparatus of claim 3 wherein said central panel portion and said peripheral container-connector portion are made as a unified structure from a single piece of plastic material.

5. A container lid and cutting board apparatus, comprising:

a rigid central panel portion, and a flexible peripheral container-connector portion attached to said central panel portion, wherein said peripheral container-connector portion includes a bridging ring portion attached to said central panel portion, and a container rim reception flange attached to said bridging ring portion, wherein said central panel portion has a panel thickness, said bridging ring portion has a ring thickness, and said panel thickness is greater than said ring thickness, wherein said flexible peripheral container-connector portion and said central panel portion each has a first surface and a second opposed surface, and said first surface of said central panel portion is coplanar with respect to said first surface of said flexible peripheral container-connector portion on said first surface, and wherein said flexible peripheral container-connector portion second opposed surface includes a container rim reception flange and said container rim reception flange extends beyond said central panel portion second opposed surface.

6. The apparatus of claim 5 wherein said central panel portion and said peripheral container-connector portion are made as a unified structure from a single piece of plastic material.

* * * * *